United States Patent [19]

Mateias

[11] Patent Number: 4,919,157

[45] Date of Patent: Apr. 24, 1990

[54] METHOD OF CLEANING METAL COMPONENTS FOR CATHODE RAY TUBES

[75] Inventor: Emil Mateias, Aachen, Fed. Rep. of Germany

[73] Assignee: U.S. Philips Corporation, New York, N.Y.

[21] Appl. No.: 368,999

[22] Filed: Jun. 14, 1989

Related U.S. Application Data

[63] Continuation of Ser. No. 240,403, Aug. 30, 1988, abandoned, and a continuation of Ser. No. 99,269, Sep. 21, 1987, abandoned.

[30] Foreign Application Priority Data

Nov. 20, 1986 [DE] Fed. Rep. of Germany ..... 3639657

[51] Int. Cl.[5] ..... C23G 5/00

[52] U.S. Cl. ..... 134/2; 29/DIG. 7; 29/81.01; 134/19; 134/42; 445/59

[58] Field of Search ..... 134/2, 19, 42; 445/59; 29/81 C, DIG. 7

[56] References Cited

FOREIGN PATENT DOCUMENTS

| | | | |
|---|---|---|---|
| 0149927 | 7/1985 | European Pat. Off. . | |
| 0157708 | 10/1985 | European Pat. Off. . | |
| 0233658 | 8/1987 | European Pat. Off. . | |
| 0126231 | 10/1981 | Japan | 445/59 |
| 58-59529 | 4/1983 | Japan | 445/59 |
| 0059529 | 4/1983 | Japan | 445/59 |

*Primary Examiner*—Asok Pal

*Attorney, Agent, or Firm*—Norman N. Spain

[57] ABSTRACT

Metal components for cathode ray tubes have up till now been degreased by washing with halogenated hydrocarbons. These degreasing agents pollute the environment, The new method is ecologically sound and the metal components are cleaned so thoroughly that they may be used for high vacuum applications. The metal components (12) to be cleaned are preferably heated in a reducing atmosphere at 500° to 800° C. for 5 to 45 minutes in a continuous furnace (1) which is formed integral with a blackening furnace (2).

The method enables a simple, reproducible undangerous and ecologically sound cleaning. After burning the exhaust gases the emissions only consist of carbon dioxide and water.

7 Claims, 1 Drawing Sheet

METHOD OF CLEANING METAL COMPONENTS FOR CATHODE RAY TUBES

This is a continuation of application Ser. No. 240,403 filed Aug. 30, 1988 and a continuation of Ser. No. 099,269 filed Sept. 2, 1987 now both abandoned.

BACKGROUND OF THE INVENTION

The invention relates to a method of cleaning metal components for cathode ray tubes.

Such components, for example, shadow masks, mask frames, and inner cones for color display tubes, are conventionally degreased by washing with halogenated hydrocarbons. These degreasing agents pollute the environment. Moreover the possibility exists that chlorine-and carbon-containing residues remain on the components.

SUMMARY OF THE INVENTION

It is the object of the invention to provide an ecologically sound cleaning method which ensures not only a complete degreasing but also ensures the required purity with respect to other impurities.

According to the invention this object is achieved by a method in which the metal components to be cleaned are heated in a reducing atmosphere at 500° to 800° C. for from 5 to 45 minutes, preferably from 10 to 25 minutes.

DETAILED DESCRIPTION OF THE INVENTION

Figure 1:
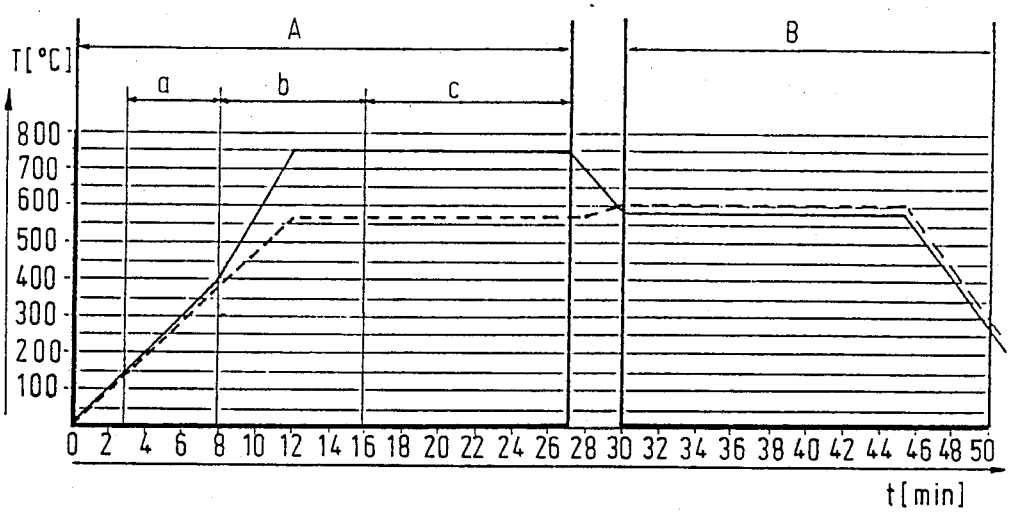
FIG. 1 is a graph showing the relation of time and temperature to the thermal degreasing operation of the invention and FIG. 2 is a diagrammatic view of an arrangement for the thermal degreasing and blackening of metal components for cathode ray tubes according to the method of the invention.

The invention will now be described in greater detail with reference to the drawing.

Heating is preferably carried out in an atmosphere of up to 96% by volume of nitrogen, 4 to 8% by volume of hydrogen, and an amount of water vapor such that the dew point is between about −10° C. and about 25° C.

In a particularly favorable embodiment of the method according to the invention the composition and the temperature of the atmosphere during the process are controlled so that the following reaction sequence occurs:

a. evaporation of oil from the surface of the metal components;

b. a weak oxidation of the surface by the water vapor, i.e. by the moisture of the atmosphere;

c. a reduction of the oxidised surface.

Furthermore it is advantageous to heat the metal components to be cleaned in a continuous furnace, in particular in such a furnace which is formed integral with a furnace for a further thermal treatment, for example, with a blackening furnace. The exhaust gases resulting from the evaporation are preferably guided into the gas burners of the integrally formed furnace and are combusted there. The advantage of this is that the emissions then consist only of carbon dioxide and water.

The method according to the invention has the advantage of being simple, reproducible, safe and ecologically sound. In this method a series of treatment and transport steps previously required are omitted so that the possibility of damage to the metal components is reduced. Also in the method according to is the invention not only the oil present on the surface of the metal components evaporated but residues of organic material optionally present on the metal surface are also reduced. As a result of this the components treated according to the invention are suitable for applications in a high vaccum.

Additionally, as compared with baking, i.e. a thermal treatment in the presence of oxygen, the method according to the invention has the advantage that no combustion residues remain on the metal surface.

Furthermore, the temperature in the thermal degreasing influences the physical-mechanical properties of the components, for example, the magnetism in a positive manner. This also applies to high-alloy materials, for example INVAR steels (alloys containing 36 percent nickel and about 64 percent iron), the surface of which is treated with materials which are particularly difficult to remove. Thermal degreasing is also cheaper than degreasing with chemical agents.

An embodiment of the invention is shown in the drawing and will be explained in detail hereinafter.

In the graph shown in of FIG. 1 the time t in minutes is plotted on the abscica and the temperature T in centigrades is plotted on the ordinate. The cleaning phase is denoted by A, a subsequent blackening phase by B. The thermodynamic processes occurring during the cleaning phase A consist of three steps or stages, namely a. evaporation of oil, b. weak oxidation of the surface by the moisture of the atmosphere, and c. subsequent reduction of the very thin oxide layer produced in b by the hydrogen share of the atmosphere.

Process steps b and c were carried out in an oxygen-free atmosphere consisting of 94% by volume of nitrogen and 6% by volume of hydrogen. The dew-point of the moisture in process step b was approximately 25° C., in process step c it was at most 0° C.

The broken-line curve denotes the temperature/time variation in the treatment of shadow masks and diaphragm parts, the solid-line curve denotes that of INVAR masks and screening cones.

Figure 2:
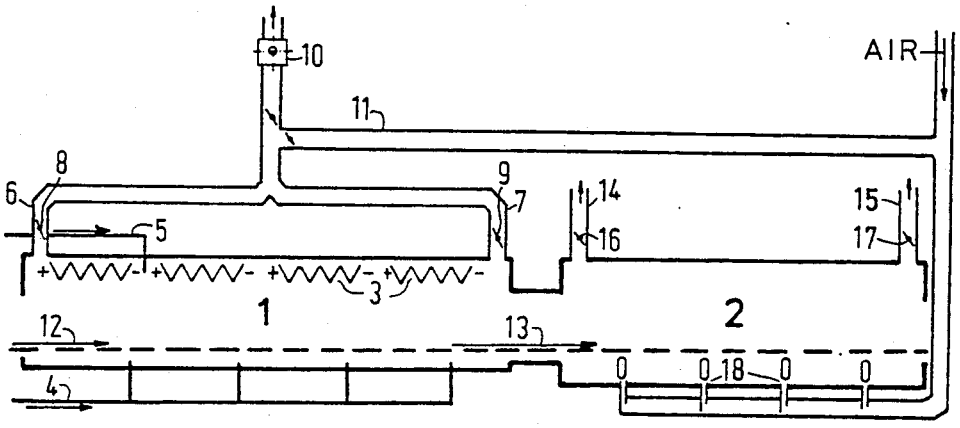

The device shown in FIG. 2 consists of a continuous furnace 1 which is formed integral with a blackening furnace 2. The continuous furnace can be heated by means of electric heating members 3. Via a gas pipe 4 a gas mixture consisting of 94% by vol. of nitrogen and 6% by vol. of hydrogen is passed through the furnace 1. A corresponding quantity of moisture (to provide a dew point of at most 25° C.) is guided into the furnace 1 via a water vapor pipe 5.

The pressure and flow rate in the furnace 1 are adjusted by chimneys 6 and 7 with shut-off members 8 and 9. The oil-containing exhaust flow is either burned in a burner 10 or is supplied to the gas burners of the blackening furnace 2 through a pipe 11.

The furnace 1 is heated at an operating temperature which, in the case of shadow masks and mask frames and mask diaphragms, respectively, is from 530° to 580° C., for masks of INVAR steel is 750° to 800° C., and for inner cones is from 700° to 750° C. The metal components corresponding to said temperature are then passed through the furnace 1, which is indicated by an arrow 12. The residence time of the components in the furnace 1 is in the order of magnitude of 25 minutes. The components are then guided through the blackening furnace 2, as indicated by an arrow 13, which is equipped with gas exhausts 14 and 15 having shut-off members 16 and 17, respectively as well as gas burners 18.

What is claimed is:

1. A method for cleaning a metal component for a cathode ray tube whereby oil present on the surfaces of the metal component is removed from these surfaces characterized in that:

(a) the metal component is heated at a temperature of less than 400° C. in an inert atmosphere to thereby evaporate oil from said surfaces;

(b) the surfaces are then oxidized by water vapor by heating the metal component in a weakly oxidizing atmosphere comprising 92 to 96% by volume of nitrogen, 4 to 8% by volume of hydrogen and water vapor in an amount such that the dew point is 25° C. to −10° C. at a temperature of 500° C. to 800° C.;

(c) and then reducing said oxidized surfaces by heating said metal component in a reducing atmosphere comprising 92 to 96% by volume of nitrogen, 4 to 8% by volume of hydrogen and water vapor in an amount such that the dew point of said reducing atmosphere is less than 0° C. at a temperature of 500° C. to 800° C.

2. A method as claimed in claim 1, characterized in that for a further thermal treatment the cleaned metal components are supplied to a blackening furnace which is formed integral with the continuous furnace.

3. A method as claimed in claim 1, characterized in that the reactor sequence is carried out in a continuous furnace integral with a blackening furnace provided with gas burners, and the exhaust gases formed during the evaporation are introduced into the gas burners of the blackening furnace and are burned there.

4. The method of claim 1 wherein said metal component is heated for 5 to 45 minutes.

5. The method of claim 4 wherein metal component is heated for 10 to 25 minutes.

6. The method of claim 4 wherein said component is an Invar-steel metal component.

7. The method of claim 1 wherein the metal component is heated in a continuous furnace.

* * * * *